United States Patent [19]

Tozawa et al.

[11] Patent Number: 4,486,512

[45] Date of Patent: Dec. 4, 1984

[54] RADIOACTIVE WASTE SEALING CONTAINER

[75] Inventors: Seiichi Tozawa, Ibaraki; Seii Sugimoto, Saitama; Toshio Kitamura, Tokyo, all of Japan

[73] Assignee: Mitsui Mining & Smelting Co., Ltd., Tokyo, Japan

[21] Appl. No.: 465,415

[22] Filed: Feb. 10, 1983

[30] Foreign Application Priority Data

Feb. 10, 1982 [JP] Japan ..... 57-18813
May 25, 1982 [JP] Japan ..... 57-87351

[51] Int. Cl.[3] ..... C25D 3/04

[52] U.S. Cl. ..... 428/623; 220/326; 428/626

[58] Field of Search ..... 428/623, 626; 220/326

[56] References Cited

U.S. PATENT DOCUMENTS 2,945,718 7/1960 Smith ..... 220/326
3,506,413 4/1970 Uchida et al. ..... 428/623
3,650,708 3/1972 Gallagher ..... 428/623
3,958,994 5/1976 Burnett ..... 428/623
4,111,476 9/1978 Jacobs ..... 220/326
4,407,899 10/1983 Hara et al. ..... 428/623

*Primary Examiner*—Veronica O'Keefe
*Attorney, Agent, or Firm*—Sughrue, Mion, Zinn, Macpeak & Seas

[57] ABSTRACT

A low- to medium-level radioactive waste sealing container is constructed by depositing a foundation coating consisting essentially of zinc, cadmium or a zinc-aluminum alloy over a steel base, then coating an organic synthetic resin paint containing a metal phosphate over the foundation coating, and thereafter coating an acryl resin, epoxy resin, and/or polyurethane paint. The sealing container can consist of a main container body, a lid placed over the main body, and fixing members for clamping and fixing the lid to the main body. Each fixing member may consist of a material obtained by depositing a coating consisting essentially of cadmium or a zinc-aluminum alloy over a steel base.

12 Claims, No Drawings

RADIOACTIVE WASTE SEALING CONTAINER

BACKGROUND OF THE INVENTION

This invention relates to a radioactive waste sealing container which is used when low- to medium-level radioactive waste generated in atomic power plants, atomic power research installations, etc., is to be processed, disposed of, or stored.

When processing the low- to medium-level radioactive waste generated in atomic power installations, in general the inflammable material contained in the waste such as paper and fibers and burned and then sealed into a steel container (e.g. drum) coated on its inner and outer surfaces with a melamine-alkyd or epoxy resin paint for storage, while liquid or non-combustible solid contents are subjected to a concentration or compression treatment as they are, are then solidified by the use of cement or asphalt, and are thereafter sealed into a steel container of the type described above. However, the paint coating of the steel drums or containers coated with the melamine-alkyd or epoxy resin paint is likely to be damaged during such processes as the solidification treatment and sealing of the radioactive waste, or the transportation of the drum or container, and this damage results in the occurrence of corrosion of the steel base, accelerates the deterioration of the coating, and eventually promotes the corrosion of the steel base. The progress of the corrosion of the steel base due to the deterioration of the coating is markedly dependent upon the environmental conditions in which the drum or container is stored, but in view of the fact that atomic power installations are generally situated near the sea, external factors that can cause and promote corrosion such as brine particles and moisture are abundunt. The interior of the container is inevitably exposed to chemical action by radioactive waste containing chlorides and sulfates. For these reasons, if the coating is damaged for some reason or other, corrosion proceeds on both the inner and outer surfaces of the container so that leakage of radioactivity occurs, and the overall safety of atomic power is reduced.

To eliminate these problems, various proposals have been made in the past. For example, Japanese Patent Publication No. 957/1982 discloses a method which provides a foundation coating for the steel container by zinc plating or flame spraying with zinc, and then an organic paint containing a zinc phosphate is painted thereon. Japanese Patent Publication No. 958/1982 discloses a method in which a foundation coating is first provided over the steel container using a paint consisting of zinc as a principal component, or zinc plating or zinc flame spraying, and then a paint consisting principally of tar or asphalt is painted thereover. These prior art methods can improve the corrosion resistance to some extent, it is true, but they are not yet entirely satisfactory because the coatings swell as they are brought into contact with the contents of the container, such as chlorides and sulfates, for an extended period of time, and they have a rather low heat resistance.

The prevention of corrosion of the container has thus been one of the most essential requirements for the assurance of the complete safety of atomic power installations.

The container of the kind described above consists generally of a main container body and a lid, and after the lid has been placed over the main body, they are fixed together by fixing members obtained by applying a thin electroplating of zinc to a steel base, or by subjecting a steel base to a surface treatment such as zinc plating. Although the steel fixing members subjected to the surface treatment of a thin electroplating of zinc provides a corrosion resistance for a brief period of time, the thin zinc plating layer wears out gradually as the container is stored for a long period of time, and iron rust develops on the fixing members to deteriorate them earlier than the main container body, thereby breaking the seal between the main body and the lid of the sealing container.

To solve this problem, an attempt has been made conventionally to increase the thickness of the electroplating layers of the fixing members, but an extremely thick plating would reduce the adhesion of the plating to the steel base of the fixing members so that the plating surface will become non-uniform, and the corrosion-resistant metal coating will peel off from the plating surface. Morever, since there is an inherent limit to the thickness of an electroplating layer, this method is not always effective.

A surface treatment such as painting has been made over a steel base but this method is not entirely satisfactory, either, because the coating is likely to be damaged during the transportation of the radioactive waste sealing container, and eventually this causes the corrosion of the steel base immediately after the start of the storage of the container, accelerates the corrosion of the coating and eventurally promotes the corrosion of the steel base. Moreover, since oxygen concentration cells are formed in the spaces between the container lid and the fixing members, the cell action promotes the corrosion of the lid, causes a leakage of radioactivity, and thus deteriorates the safety of atomic power. The prevention of the corrosion of the fixing members has thus been another essential requirement for the assurance of the complete safety of atomic power installations.

SUMMARY OF THE INVENTION

It is therefore an object of the present invention to provide a sealing container having a greatly improved corrosion resistance within the storage environments in the processing, disposal and storage of low- to medium-level radioactive waste, in order to ensure the complete safety of atomic power.

It is another object of the present invention to provide a fixing member having a greatly improved corrosion resistance for use in a sealing container for low- to medium-level radioactive waste, in order to ensure the complete safety of atomic power.

In accordance with the present invention, a radioactive waste sealing container is provided which is characterized in that a foundation coating consisting essentially of zinc, cadmium, or a zinc-aluminum alloy is formed over a steel base forming the sealing container, an organic synthetic resin paint containing a metal phosphate is applied over the foundation coating, and an acryl resin, epoxy resin, and/or a polyurethane resin paint is further applied thereon.

In a radioactive waste sealing container consisting of a main container body, a lid and fixing members for clamping and fixing the lid to the main container body, the present invention also provides a sealing container characterized in that a coating consisting essentially of cadmium or a zinc-aluminum alloy is deposited on a steel base that forms the fixing member.

DESCRIPTION OF THE PREFERRED EMBODIMENTS

If a zinc-aluminum alloy is used as the foundation coating for the sealing container of the present invention, the aluminum content should be between 0.5 to 30% by weight, preferably between 1 to 7% by weight, in view of its corrosion resistance, machinability and producibility. The anticorrosive performance and hardness can be further improved by use of a zinc alloy as the foundation coating, which alloy is prepared by adding 0.01 to 5% by weight, of at least one substance selected from the group consisting of magnesium, copper, tin, titanium, manganese, nickel, silicon and misch metal to the zinc-aluminum alloy described above.

The foundation coating of the sealing container of the present invention can be formed by hot dipping, electroplating, flame spraying, coating, etc. It is preferable that the foundation coating is applied to the steel base before the base is shaped into the container.

The metal phosphate of the metal phosphate-containing organic synthetic resin paint applied over the foundation coating of the container of the present invention is typically exemplified by a phosphate of a metal such as zinc, aluminum, cadmium, iron or calcium; and the organic synthetic resin in this case is typically exemplified by a polyester, phenol or epoxy resin.

It is preferable that the metal phosphate-containing organic synthetic resin paint, and the acryl resin, epoxy resin, and/or polyurethane paint that are applied over the former, be deposited after the steel base is shaped into the container.

The radioactive waste sealing container in accordance with the present invention is characterized in that the steel base is protected by at least three protective layers, and these protective layers prevent any external leakage of radioactivity resulting from the corrosion of the inner or outer surfaces of the sealing container.

More definitely, since an acryl resin, epoxy resin, and/or polyurethane paint, each having high degree of water-proofness and chemical resistance, is coated as the external layer, the penetration of corrosive media into the steel base through the paint coating is much more restricted than when the existing melamine-alkyd resin paint having a large water permeability is used, and hence the period before corrosion occurs in the steel base can be dramatically extended.

Since an organic synthetic resin paint containing a metal phosphate such as zinc phosphate is deposited below or within the paint of the external layer, it improves the adhesion between the metal coating over the base and the paint of the upper layer, and since the metal phosphate forms a compact and strong coating, the resultant covering absorbs any applied corrosive factors such as water, chlorine ions, sulfur ions and the like, and prevents the formation of local cells which would otherwise result in the occurrence of corrosion.

Since a foundation coating consisting essentially of zinc, cadmium or a zinc-aluminum alloy is deposited over the surface of the steel base, the foundation coating with its high corrosion resistance would prevent the corrosion of the steel base even if the upper coatings were broken or damaged. In particular, a cadmium coating has a high resistance against chlorides and a high condensed water resistance. A zinc-aluminum alloy coating has a much higher corrosion resistance when compared with coatings formed by hot dipping or flame spraying by pure zinc, and exhibits the effect of preventing electrolytic corrosion by a sacrificial cathode operation if a scratch extending as far as the steel base should develop for some reason or other, thereby preventing the corrosion of the steel base.

It is well known in the art that a radioactive waste sealing container produced by coating a metal phosphate-containing organic synthetic paint over zinc-coated steel sheet exhibits an anti-corrosive effect to some extent, as described above. The present invention uses, as the foundation coating, zinc, cadmium, a zinc-aluminum alloy or an alloy prepared by adding at least one substance selected from the group consisting of magnesium, copper, tin, titanium, manganese, nickel, silicon, and misch metal to the zinc-aluminum alloy, and combines this foundation coating with a metal phosphate-containing organic synthetic resin paint, and an acryl resin, epoxy resin, or polyurethane paint as the upper layers in order to provide a low- to medium-level radioactive waste-sealing container having a further improved anti-corrosion effect.

In the container of the present invention, a three-layered coating such as that described above can be applied only to the outer surface with the inner surface being coated with a thin sheet of a metal which is more cathodic than iron. Alternatively, the three-layered coating can be applied to both the inner and outer surfaces. For the metal which is more cathodic than iron (that is, having a base potentiai), the most preferred are zinc, aluminum and zinc-aluminum alloys. The thin sheet should be between 0.1 and 0.7 mm thick, for example, and is preferably between 0.3 and 0.5 mm thick. The thin sheet can be obtained easily by rolling.

It is not always necessary that the coating should be completely attached to the inner surface of the container. In other words, the coating may be formed like a kind of inner bag, which is naturally brought into contact with the inner surface by the weight of the radioactive waste sealed into the container. It is possible, for example, to produce a container made of a thin sheet in a size approximately equal to the inner surface of the sealing container, and to place it into the sealing container or to bond the thin sheet around the inner surface of the sealing container by the use of an adhesive, by spot welding or by soldering. Alternatively, the thin sheet can be fitted around the inner surface of the sealing container in accordance with a heretofore known mechanical method.

The sealing container in accordance with the present invention includes those types of containers which consist of a main body and a lid to be put on the former by fixing members.

A fixing member is preferably produced by depositing a coating consisting essentially of cadmium or a zinc-aluminum alloy over a steel base. The zinc-aluminum alloy in this instance has an aluminum content of 0.5 to 30% by weight, preferably 1 to 7% by weight, in view of the corrosion resistance, machinability and producibility. The corrosion resistance and hardness can be further improved by adding 0.01 to 5% by weight, preferably 0.5 to 3% by weight, of at least one substance selected from the group consisting of magnesium, copper, tin, titanium, manganese, nickel, silicon and misch metal to the zinc-aluminum alloy described above.

The fixing member for the radioactive waste sealing container in accordance with the present invention is characterized in that a steel base is coated by cadmium or a zinc-aluminum alloy having a high corrosion resistance and a high adhesion, and since this coating layer is provided, the corrosion of the members fixing the lid to the main container body, sealing therein the low- to medium-level radioactive waste, can be prevented and hence any external leakage of radioactivity due to the corrosion of a fixing member can be prevented.

More specifically, since the surface of the steel base of the fixing member is coated with cadmium or a zinc-aluminum alloy, the metal layer protects the steel base from external corrosive factors and prevents corrosion. A cadmium coating has a particular high resistance to chlorides and condensed water. A zinc-aluminum coating in particular has a much higher corrosion resistance than a coating obtained by the flame spraying or coating of pure zinc, exhibits a sacrificial cathodic action if a scratch extending as far as the steel base should occur for some reason or other, and completely prevents the corrosion of the steel base.

In the fixing member of the present invention, a metal phosphate-containing organic synthetic resin paint can be deposited over the coating consisting of cadmium or zinc-aluminum alloy, and an acryl resin, epoxy resin, and/or polyurethane paint can be deposited further thereon, in the same way as in the main container body and the lid.

Next, some examples of the invention will be described but it must be noted that they are merely illustrative and are in no way limitative.

EXAMPLE 1

To examine the corrosion-preventing effect of the container of the present invention, sealing containers such as those listed in Table 1 were produced and were subjected to exposure tests in an outdoor atmosphere, in the ground and in indoor storage for five to six years.

TABLE 1

Container (1) Material: steel JIS SPCC, 1.2 mm thick
(2) Size and shape: 285 mm (diameter) × 320 mm (height) pail-shaped drum.

| Item | Sample a | b | c | d | e | f | g | h |
|---|---|---|---|---|---|---|---|---|
| Foundation coating | Zn Hot dipping | Zn Flame spraying | Zn-5% Al Hot dipping | Zn-5% Al 3% Mg Hot dipping | Zn-12% Al-0.5% Cu-0.1% Ti Flame spraying | Zn-7% Al-1% Si-2% Sn Hot dipping | Cd Hot dipping | Cd Flame spraying |
| Conversion treatment | zinc phosphate | wash primer | zinc phosphate | zinc phosphate | wash primer | zinc phosphate | zinc phosphate | wash primer |
| (conversion treatment) | Yes | Yes | Yes | Yes | Yes | Yes | Yes | Yes |
| Intermediate coating | coating of polyester resin (A) | coating of polyester resin (A) | coating of polyester resin (A) | coating of epoxy resin (B) | coating of epoxy resin (B) | coating of polyester resin (A) | coating of polyester resin (A) | coating of epoxy resin (B) |
| Coating of outer layer | | | | | | | | |
| outer surface | coating of acryl resin | coating of acryl resin | coating of acryl resin | coating of acryl resin | coating of acryl resin | coating of acryl resin | coating of acryl resin | coating of acryl resin |
| inner surface | coating of acryl resin | coating of epoxy resin | coating of epoxy resin | coating of acryl resin | coating of epoxy resin | coating of epoxy resin | coating of epoxy resin | coating of acryl resin |
| Fixing member | Zn-5% Al Hot dipping | Zn-5% Al Flame spraying | Zn-5% Al Hot dipping | Zn-5% Al 3% Mg, Hot dipping | Zn-12% Al-0.5% Cu-0.1% Ti Flame spraying | Zn-7% Al-10% Si-2% Sn Hot dipping | Cd Hot dipping | Cd Flame spraying |
| Remarks | This invention | This invention | This invention | This invention | This invention | This invention | This invention | This invention |

| Item | Sample i | j | k | l | m | n | o |
|---|---|---|---|---|---|---|---|
| Foundation coating | — | — | Zn Flame spraying | Zn Hot dipping | Zn powder painting | Zn Flame spraying | Zn Hot dipping |
| Conversion treatment | zinc phosphate | zinc phosphate | wash primer | zinc phosphate | sand blasting | wash primer | zinc phosphate |
| (conversion treatment) | Yes | Yes | Yes | Yes | Yes | Yes | Yes |
| Intermediate coating | None | None | coating of polyester resin (B) | coating of polyester resin (B) | coating of polyester resin (B) | coating of polyester resin (B) | coating of polyester resin (B) |
| Coating of outer layer | | | | | | | |
| outer | coating | coating | None | None | coating | coating | coating |

TABLE 1-continued

| | | | | | | | |
|---|---|---|---|---|---|---|---|
| surface | of melamine resin | of melamine resin | | | of tar resin (C) | of tar resin (C) | of asphalt (D) |
| inner surface | coating of melamine resin | coating of epoxy resin | None | None | coating of tar resin (C) | coating of tar resin (C) | coating of asphalt (D) |
| Fixing member | Zn electroplating | Electroplating | Electroplating | Electroplating | Electroplating | Electroplating | Electroplating |
| Remarks | Prior art | Prior art | Prior art | Prior art | Prior art | Prior art | Prior art |

N.B.
(A) polyester resin containing zinc phosphate
(B) epoxy resin containing zinc phosphate
(C) coating at normal temperature

[Note]
(1) Thicknesses of metal foundation coatings:
a, c, d, f, g, l, o=40 to 50μ
b, e, h, k, n=at least 75 μm
(2) Coating thicknesses:
Usually 35 to 50 μm with the exception of m in which the foundation coating was 20 to 30 μm and the total thickness 55 to 70 μm.

EXAMPLE 2

The containers produced in Example 1 were each exposed in an outdoor atmosphere near the sea, were buried in the ground 1 m below the surface at the same site, and were stored in a warehouse near the sea to examine their lifetimes over a period of five to six years. The contents of the containers were as follows:

Containers exposed to the outdoor atmosphere:
Concrete-solidified material using an aqueous solution containing 15% $Na_2SO_4$ and 0.7% NaCl.

Containers buried in the ground:
Vermiculite cement-solidified material using an aqueous solution containing 10% $Na_2SO_4$, 1% NaCl and 3% $Na_3BO_3$.

Containers stored in the warehouse:
Same as the containers exposed to the outdoor atmosphere.

The environmental conditions for these tests were as follows:

Exposure to the outdoor atmosphere:
The containers were placed at a position by 150 m inland from the seashore, where brine particles were always spraying from the sea, brine splashed on the container when the wind was strong, and which was directly exposed to the suns rays.

Containers buried in the ground:
The containers were buried in the soil close to those containers exposed to the outdoor atmosphere. The soil was a clay soil which contained small rocks and stones. The pH was 6.5 and the soil resistance was 1100 to 2500 Ohm-cm.

Containers stored in the warehouse:
The warehouse was situated close to those containers exposed to the outdoor exposure, and was constructed of a steel skeleton covered with slates. Brine-containing air entered the warehouse through the gaps, and the humidity was as high as 70 to 90%. Although the direct rays of the sun did not touch the containers, the indoor temperature was as high as 35° to 40° C. in the summer and dropped to the external temperature in winter.

The results of the tests are illustrated in Table 2.

TABLE 2

| Sample | | This invention | | | | | | | | Prior art | | | | | | |
|---|---|---|---|---|---|---|---|---|---|---|---|---|---|---|---|---|
| | | a | b | c | d | e | f | g | h | i | j | k | l | m | n | o |
| Outdoor exposure (6 years) | Outer surface of container | 5 | 5 | 5 | 5 | 5 | 5 | 5 | 5 | 1 | 1 | 3 | 2 | 3 | 3 | 3 |
| | Inner surface of container | 5 | 5 | 5 | 5 | 5 | 5 | 5 | 5 | 1 | 2 | 2 | 2 | 3 | 3 | 3 |
| | Fixing member | 5 | 5 | 5 | 5 | 5 | 5 | 5 | 5 | 1 | 1 | 1 | 1 | 1 | 1 | 1 |
| Buried in ground (6 years) | Outer surface of container | 4 | 4 | 5 | 5 | 5 | 5 | 5 | 5 | 1 | 1 | 3 | 2 | 3 | 3 | 3 |
| | Inner surface of container | 4 | 4 | 5 | 5 | 5 | 5 | 5 | 5 | 1 | 2 | 2 | 2 | 3 | 3 | 3 |
| | Fixing member | 5 | 5 | 5 | 5 | 5 | 5 | 5 | 5 | 1 | 1 | 1 | 1 | 1 | 1 | 1 |
| Indoor storage (5 years) | Outer surface of container | 5 | 5 | 5 | 5 | 5 | 5 | 5 | 5 | 2 | 2 | 4 | 3 | 4 | 4 | 4 |
| | Inner surface of container | 5 | 5 | 5 | 5 | 5 | 5 | 5 | 5 | 1 | 1 | 2 | 2 | 3 | 3 | 3 |
| | Fixing member | 5 | 5 | 5 | 5 | 5 | 5 | 5 | 5 | 2 | 2 | 1 | 1 | 1 | 1 | 1 |

Judgement
5: Hardly any abnormalities
4: Deterioration of film, partial peeling, no rust; no problems for practical use
3: Serious deterioration of film, rust developed but no local corrosion
2: Marked development of rust and marked local corrosion
1: Extremely marked corrosion, practical application impossible As can be seen from Table 2, the containers in accordance with the present invention displayed hardly any abnormalities irrespective of the installation site such as outdoors, underground and indoors, and were found to be sufficiently corrosion-resistant for an extended period of time.

Corrosion of a container generally proceeds at the contact between the main body and the lid of the container, the edges and welds of the container, over the coating, and on the damaged areas.

In addition to the double or triple protective layers of the main body of the sealing container per se, the steel base is coated with cadmium or a zinc-aluminum alloy. It is thus obvious that the service life to the container can be markedly extended.

Since the steel base of the fixing members, whose corrosion resistance has been one of the critical problems with the prior art, is coated with the zinc-aluminum alloy or cadmium, the combination of this fixing member with the main container body can provide a radioactive waste sealing container which can remain corrosion-resistant for an extended period of time.

Corrosion resistance of low- to medium-level radioactive waste sealing containers is one of the essential conditions needed to ensure safety in the peaceful utilization of nuclear power. In this conjunction, the sealing container in accordance with the present invention provides an extremely significant achievement, and it also a high industrial value because the container can be produced economically without using any particularly expensive materials.

What is claimed is:

1. A radioactive waste sealing container characterized in that a foundation coating selected from the group consisting of zinc, cadmium and a zinc-aluminum alloy is applied over a steel base forming said container, an organic synthetic resin paint containing a metal phosphate is coated over said foundation coating, and at least one of an acryl resin paint, epoxy resin paint and polyurethane paint is coated over said organic synthetic resin paint.

2. The radioactive waste sealing container as defined in claim 1 wherein said foundation coating consists essentially of a zinc-aluminum alloy having an aluminum content of 0.5 to 30% by weight.

3. The radioactive waste sealing container as defined in claim 2 wherein the aluminum content is between 1 to 7% by weight.

4. The radioactive waste sealing container as defined in claim 2 wherein said zinc-aluminum alloy contains 0.01 to 5% by weight of at least one substance selected from the group consisting of magnesium, copper, tin, titanium, manganese, nickel, silicon and misch metal.

5. The radioactive waste sealing container as defined in claim 1 wherein said foundation coating is formed by a method selected from the group consisting of hot dipping, electroplating, flame spraying and painting.

6. The radioactive waste sealing container as defined in claim 1 wherein said organic synthetic resin paint is selected from the group consisting of a polyester resin paint, an epoxy resin paint and a phenol resin paint contains a metal phosphate selected from the group consisting of zinc, aluminum, cadmium, iron and calcium.

7. The radioactive waste sealing container as defined in claim 1 wherein said container consists of a main container body, a lid to be placed on said main body and fixing members for clamping and fixing said lid to said main body.

8. The radioactive waste sealing container as defined in claim 7 wherein a coating selected from the group consisting of cadmium and a zinc-aluminum alloy is formed over a steel base making up said fixing members.

9. The radioactive waste sealing container as defined in claim 8 wherein said coating over said steel base of said fixing members consists essentially of a zinc-aluminum alloy having an aluminum content of 0.5 to 30% be weight.

10. The radioactive waste sealing container as defined in claim 9 wherein the aluminum content of said zinc-aluminum alloy of said coating over said steel base of said fixing members has an aluminum content of 1 to 7% be weight.

11. The radioactive waste sealing container as defined in claim 9 wherein said zinc-aluminum alloy of said coating over said steel base of said fixing members contains 0.01 to 5% by weight of at least one substance selected from the group consisting of magnesium, copper, tin, titanium, manganese, nickel, silicon and misch metal.

12. The radioactive waste sealing container as defined in claim 7 wherein said coating over said steel base of said fixing members is formed by hot dipping, electroplating, flame spraying or painting.

* * * * *